United States Patent [19]

Wittman

[11] Patent Number: 4,491,992

[45] Date of Patent: Jan. 8, 1985

[54] CONVERTIBLE BABY CRIB AND PLAYPEN

[76] Inventor: Frederick H. Wittman, 519 W. Taylor St., Sp. #127, Santa Maria, Calif. 93454

[21] Appl. No.: 548,281

[22] Filed: Nov. 3, 1983

[51] Int. Cl.[3] ..... A47D 7/00; A47D 13/06

[52] U.S. Cl. ..... 5/93 R; 5/99 B; 5/99 C

[58] Field of Search ..... 5/93 R, 99 R, 99 A, 5/99 B, 99 C, 93 B, 97, 111, 114; 256/25

[56] References Cited

U.S. PATENT DOCUMENTS

| | | | |
|---|---|---|---|
| 1,259,022 | 3/1918 | Kean et al. | 5/507 |
| 2,553,087 | 5/1951 | Hanson | 5/93 R |
| 2,901,755 | 9/1959 | Wood | 5/99 R |
| 3,643,942 | 2/1972 | Williams | 256/25 |
| 3,837,019 | 9/1974 | Hoff | 5/93 R |
| 4,433,447 | 2/1984 | Mathou | 5/93 R |

FOREIGN PATENT DOCUMENTS

| | | | |
|---|---|---|---|
| 449032 | 2/1913 | France | 5/93 R |

*Primary Examiner*—Alexander Grosz
*Assistant Examiner*—Vinh Luong
*Attorney, Agent, or Firm*—Owen, Wickersham & Erickson

[57] ABSTRACT

An adjustable-sized, readily assembled and readily disassembled baby crib made up of a series of plastic tube sections and plastic tube fittings. An invertible bottom portion is useful per se as a small short crib and, when inverted, is useful as a base portion of a taller playpen type of crib. This bottom portion has a planar assembly, a series of identical vertical tube sections, from upper sockets of the planar assembly, and a first generally rectangular assembly. In the playpen-crib the bottom portion is inverted and an upper, second generally rectangular assembly substantially identical to the first generally rectangular assembly and is connected to the long vertical tube sections.

3 Claims, 4 Drawing Figures

CONVERTIBLE BABY CRIB AND PLAYPEN

This invention relates to an improved baby crib which is adjustable as to size, is portable, is readily assembled and readily disassembled, and can be used in two basic ways, both as a short, especially portable, baby crib, or as a taller playpen type of baby crib.

BACKGROUND OF THE INVENTION

Baby cribs are often difficult to take along on a trip or to use at various locations, such as outdoors, in parks or beaches, as well as in motel rooms. There is also need for cribs that can be used indoors or outdoors at home, and can be moved back and forth readily. Typical cribs made of wood are too heavy to carry easily, and they are space-consuming assemblies.

What is needed is a portable baby crib that can be quite quickly taken apart to make the smallest possible package for shipping or for carrying along in a car, and which can be very quickly reassembled, i.e., in a matter of a few minutes. It is also important that when unassembled it be light in weight.

For example, sometimes on a trip one wishes to stop in a rest area along the highway, and it takes a good deal of labor to remove a typical baby crib from the car and set it up at that point later taking it down and putting it back in the car.

It is thus an object of the present invention to provide a crib which is easily assembled and disassembled and which is light in weight.

Another object is to provide a crib which is made up of lightweight plastic sections that consume very little space when the crib is taken apart, and yet can be put together very quickly at even a brief stop. Another object is to provide a crib which provides adaptability as to size and which also provides adaptability between two types of assemblies—one a small, short baby crib which can be used as a unit when the baby is definitely going to sleep, the other a playpen type of baby crib, for use both when the baby is asleep and awake.

SUMMARY OF THE INVENTION

The invention provides an adjustable-sized, portable, readily assembled and readily disassembled baby crib made up of a series of plastic tube sections and plastic tube fittings.

The crib includes an invertible bottom portion useful per se as a small short crib and, when inverted, useful as a base portion of a taller playpen type of crib. This invertible crib comprises three main portions:

First, there is a planar sub-assembly including two pairs of cross fittings. Each cross fitting has four horizontal, co-planar sockets at 90° intervals. Two long lengthwise-extending tube sections of identical length connect the cross fittings of each pair together, and a shorter lengthwise-extending outboard tube section extends out from each cross fitting in line with one of the long tube sections. All of these shorter sections are identical in length.

Two long widthwise-extending tube sections, of identical length, connect corresponding cross fittings of one pair to those of the other pair and extend at 90° to the lengthwise sections. A shorter widthwise-extending outboard tube section extends out from each cross fitting in line with a respective long widthwise-extending tube sections. All of these shorter widthwise sections are identical in length.

Thus, the bottom portion of the crib includes four lengthwise outboard tube sections and four widthwise outboard tube sections. In addition, it includes a first set of eight 90° tee fittings, each having three sockets, with one upper socket and one lower socket in line with each other and one socket at the middle, at 90° to the upper and lower sockets. Each middle socket is attached to the distal end of one of the eight outboard tube sections. This concludes the planar sub-assembly of the bottom portion of the crib.

In addition, a second portion of the crib bottom comprises a first series of eight vertical tube sections of identical length extending upwardly from the upper sockets of each said tee section.

The third portion of the crib bottom is a first generally rectangular assembly made up mainly of tube sections connected together by fittings. There is an elbow fitting at each corner, each with two sockets at 90° to each other. In a second set of at least eight tees, each tee has two end sockets horizontally in line with each other. Tube sections horizontally connect the tees of the second set to each other and to the elbow sections. In each tee, a central vertical socket at 90° to the end sockets faces downwardly and is spaced so as to be in line with a tee of the first set of tee fittings below them. This central vertical socket receives the upper end of each vertical tube section of the stated series. The first generally rectangular assembly also has a third set of intermediate tees in between the successive tees of said second set, and substantially identical thereto, all these being interconnected by the tube sections.

This completes the bottom portion of the crib, which can be used all by itself as a small crib. A plywood slab may be placed inside on the planar sub-assembly, and a mattress may be placed over the plywood slab.

To make a complete play-pen type of crib, this bottom portion is inverted, and the first generally rectangular assembly rests on the floor or ground. Then there is an upper, second generally rectangular assembly substantially identical to the first generally rectangular assembly. When the bottom portion is inverted and the first rectangular assembly rests on a floor, this second generally rectangular assembly is spaced well above the planar sub-assembly, and it is connected to the first generally rectangular assembly by a second series of long vertical tube sections of identical length. These are substantially longer than the vertical tube sections of the first series. They join the central socket of the third set of intermediate tees to the corresponding tees of said second rectangular assembly.

Finally, a third series of vertical tube sections connect the tees of the first set to those tees of the second rectangular assembly corresponding to the tees of the second set. Their length is such that, when combined with their fittings and with the first series of tube sections, they are equal in length to the second series of vertical tube sections.

The plywood slab and mattress may then be placed on what is then the upper surface of the planar sub-assembly.

Other objects, and advantages and features of the invention will appear from the following description of a preferred embodiment.

DESCRIPTION OF A PREFERRED EMBODIMENT

Figure 3:
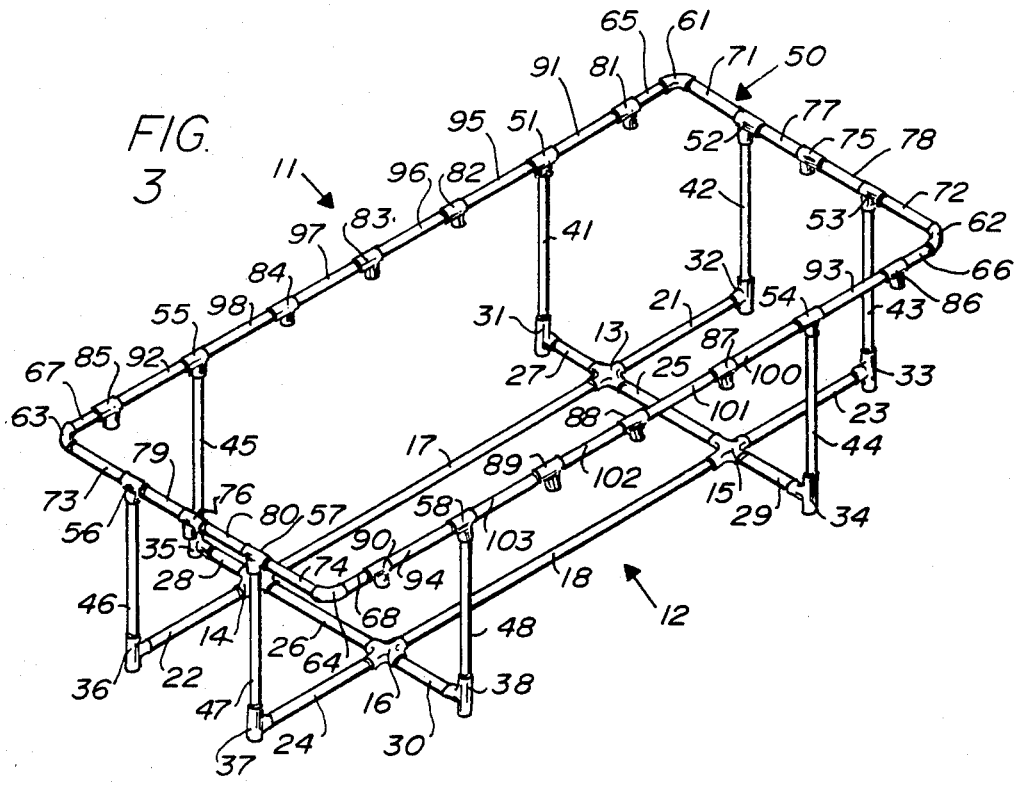
FIG. 3 is a view in perspective of the bottom portion of the crib, which can be used alone, as a shorter, narrower crib. In this instance the slab and mattress rest on what is then the upper surface of the bottom.
Figure 4:
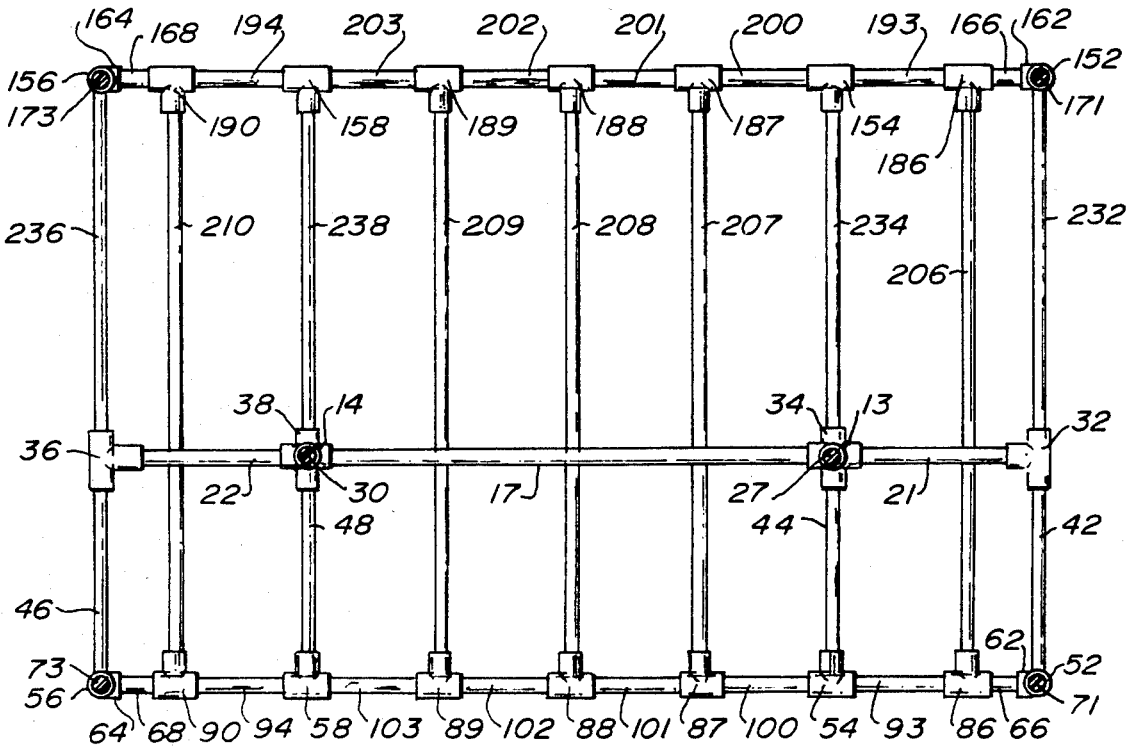
FIG. 4 is a view in section taken along the plane defined by the lines 4—4 in FIG. 1.

The crib-playpen 10 shown in the drawings, and its bottom subassembly 11 shown in FIG. 3, are made of a series of plastic elements, for example, polyvinyl chloride tube sections and fittings. They may be made of half-inch stock with the tubes simply press-fitted into the fittings, except that it is advisable to secure, as by cement, the elbows to their immediately adjacent pipe sections.

Figure 1:
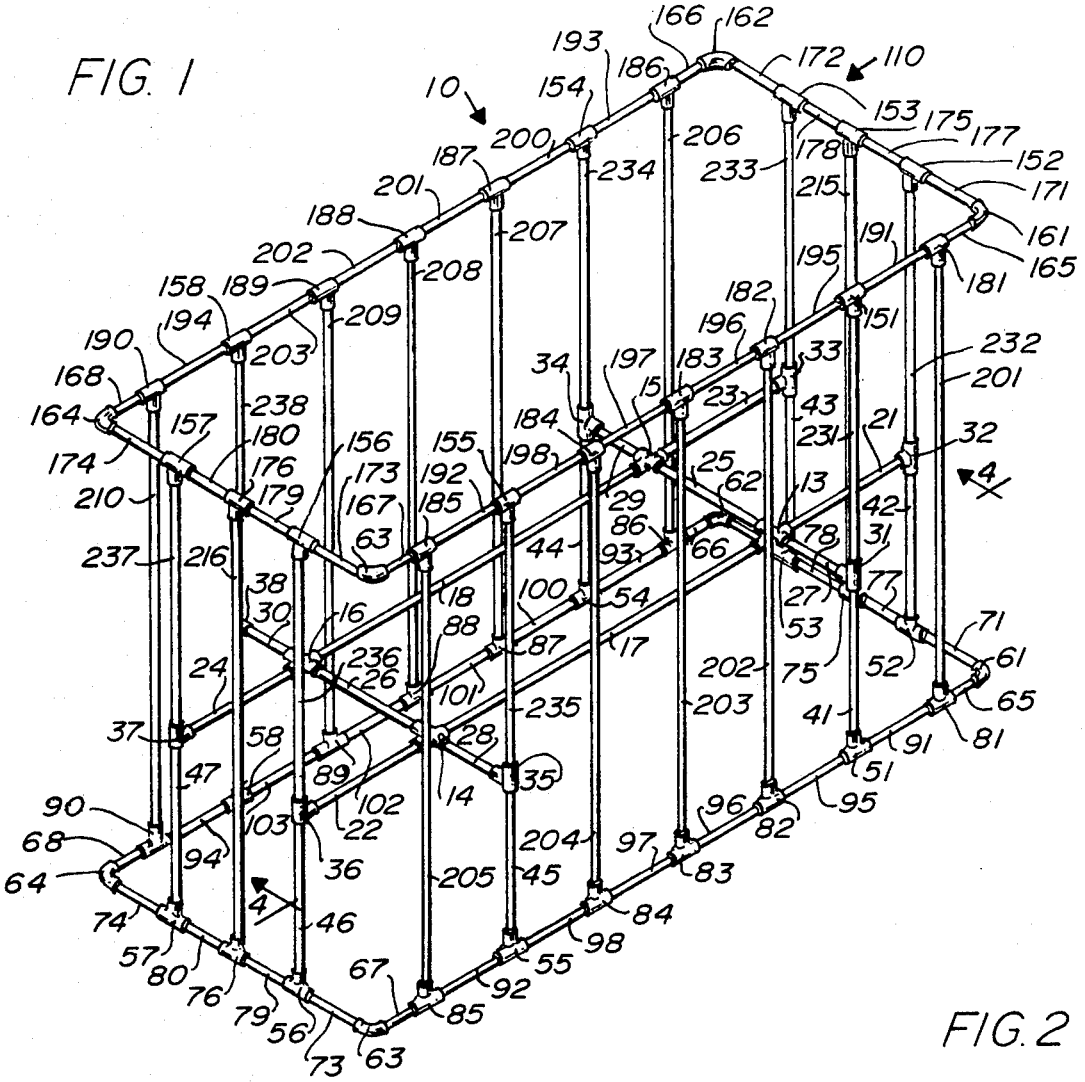
FIG. 1 is a view in perspective of the crib of the invention shown fully assembled as a playpen type of baby crib, but with the plywood slab and mattress removed.

Looking first at FIG. 3, showing the bottom portion 11 of the crib when it is used by itself (and also having regard to FIG. 1 in which that bottom portion 11 is inverted and is used as shown there), the invertible bottom portion comprises a planar subassembly 12 including four cross fittings 13, 14, 15, and 16, each having four horizontal coplanar sockets at 90° intervals. Two long lengthwise-extending tube sections 17 and 18 of identical length, connect the cross fittings of each pair together. That is, the tube section 17 connects together the cross fittings 13 and 14, and the tube section 18 connects together the cross fittings 15 and 16. In line with the tube sections 17 and 18 are four shorter lengthwise extending outboard tube sections 21, 22, 23, and 24 that extend out from the four cross fittings 13, 14, 15, and 16, respectively in line with their respective tube sections 17 and 18. Again, all of these shorter sections are preferably identical in length, although, if desired, those at one end may be of a different length from those at the other end. However, this complicates things somewhat, and is not the preferred structure.

Two relatively long widthwise-extending tube sections 25 and 26 connect the corresponding cross fittings of one pair to those of the other pair, and extend at 90° with respect to the longitudinal sections 17 and 18. Similarly, short widthwise extensions 27, 28, 29, and 30 extend outboard widthwise.

The outboard ends of all of these outboard sections, both lengthwise and widthwise, fit into the center sockets of a set of eight tees 31, 32, 33, 34, 35, 36, 37, 38. Each of these eight tees has a socket at each end which is perpendicular to the center socket. When this unit 11 is used by itself with the planar subassembly 12 as just described, the then lower sockets rest on the floor or ground. The upper sockets in this particular disposition are then each provided with one of eight vertical tube sections 41, 42, 43, 44, 45, 46, 47, and 48.

At their upper ends, these vertical tube sections are connected to the center socket of respective tees 51, 52, 53, 54, 55, 56, 57, and 58 of a first rectangular assembly 50. In addition to these tees, the assembly 50 includes four elbows 61, 62, 63, and 64. To each elbow is connected, and preferred cemented, although it may be loose if desired, a tube section in each socket of the elbow. The purpose of cementing is to make sure that the elbow will be very securely held, so that the baby by its movement cannot cause the device to come apart, as it cannot if these elbows are cemented as stated. Thus, there are four lengthwise extending tube sections 65, 66, 67, and 68 and four widthwise set section 71, 72, 73, and 74. The widthwise sections 71, 72, 73, and 74 are connected respectively to the tees 52, 53, 56, and 57. Between the two tees at each end there are similar tees 75 and 76 forming a part of second series of tees, and connected respectively to the end tees by tube sections 77 and 78 at one end and tube sections 79 and 80 at the other end. The second series of tees includes, in the lengthwise direction, tees 81, 82, 83, 84, 85, 86, 87, 88, 89, and 90. Each of the tees 81, 85, 86, and 90 is connected respectively, to an elbow 61, 63, 62, and 64 by the respective tube sections 65, 67, 66, and 68. Lengthwise, the tees 81, 85, 86, and 90 are connected by respective longitudinal tube sections 91, 92, 93, and 94 to the respective first-series tees 51, 55, 54, and 58. The tees 51 and 55 are connected together by tube section 95, tee 82, tube section 96, tee 83, tube section 97, tee 84 and tube section 98, all in line. The tees 54 and 58 are similarly connected together by tube section 100, tee 87, tube section 101, tee 88, tube section 102, tee 89 and tube section 103. This completes the first rectangular subassembly 50, which is shown in FIG. 3 at the top when the small bottom crib subassembly 11 is used in the form that is shown there. This is quite satisfactory when the baby is definitely asleep and is being watched. It can also be used as a base of operations from which the baby may crawl a short distance until it is decided to put the baby back in the crib 11.

However, when a complete playpen type of crib 10 is desired, the bottom assembly 11 forms only a part of it. It is then inverted so that the first rectangular assembly 50 rests on the ground or floor, and assembly is then continued with a second rectangular assembly 110, in which the parts are numbered as in the first assembly but one hundred higher.

This second rectangular assembly 110 is then joined to the first rectangular assembly 50 of the bottom assembly 11 by, first, a second series (1) of long vertical tube sections 211, 212, 213, 214, and 215, which extend, respectively, from the tees 181, 182, 183, 184, and 185 down to the bottom tees 81, 82, 83, 84, and 85; (2) long vertical tube sections 206, 207, 208, 209 and 210, which extend, respectively, from the upper tees 186, 187, 188, 189 and 190 down to the lower teens 86, 87, 88, 89, and 90; (3) and long vertical tube sections 215 and 216, which extend, respectively down from the upper tees 175 and 176 down to the lower tees 75 and 76. In addition, the tees 151, 155, 154, and 158 are connected respectively to intermediate tees 31, 35, 34, 38 by shorter tube sections 231, 235, 234, and 238, while tube sections 232, 233, 236, and 237, respectively, connect the upper tees 152, 153, 156, and 157 to the respective intermediate tees 32, 33, 36, and 37. In this instance, these shorter vertical tube sections 231, 232, 233, 234, 235, 236, 237, and 238 are long enough so that when added to the tube sections 41, 42, 43, 44, 45, 46, 47, and 48 and the tees 31, 32, 33, 34, 35, 36, 37, and 38, they make up the necessary equivalents in height to those provided by the long sections 211, 212 etc.

Figure 2:
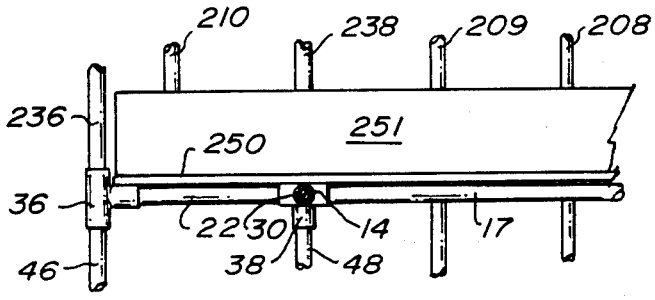
FIG. 2 is a reduced view in elevation of the crib showing the plywood slab and mattress in place.

This completes the playpen-crib assembly 10, and provides plenty of railings to keep the baby inside the crib. As shown in FIG. 2, a slab 250 of plywood may be placed on top of the planar subassembly 12, and a mattress 251 placed over that.

If desired, the longest sections 211, 212, etc. may be about 32 inches long, the tee sections on the rectangular assemblies 50 and 51 may be joined by six inch lenghtwise tube sections and five-inch widthwise tube sections. The vertical sections 41, 42, etc. of the bottom subassembly 11 may be about 12 inches long, and the shorter tube section 231, 232, etc. going to the second rectangular assembly 110 may be about 20 inches long. Other dimensions may, of course, be used, and the height and length may be shortened or lengthened as desired.

To those skilled in the art which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. An adjustable-sized, readily assembled and readily disassembled baby crib made up of a series of plastic tube sections and plastic tube fittings, said crib including in combination:

(1) an invertible bottom portion useful per se as a small short crib and, when inverted, useful as a base portion of a taller playpen type of crib, comprising (a) a planar assembly of two pairs of cross fittings, two identical lengthwise-extending first tube sections connecting the cross fittings of each pair together, four identical lengthwise-extending first tube sections, one extending out from each cross-fitting in line with a said first tube section, two identical widthwise-extending third tube sections, connecting corresponding cross fittings of one pair to those of the other pair, four identical shorter widthwise-extending fourth tube section, each extending out from a said cross fitting in line with a third widthwise-extending tube section, a set of eight 90° first tee fittings, each with one upper socket, one lower socket, and one middle socket, a said middle socket being attached to the distal end of each of the second and fourth tube sections, (b) a first series of identical vertical fifth tube sections, each extending upwardly from an upper sockets of each said first tee section, and (c) a first generally rectangular assembly, having an elbow fitting at each corner a set of at least eight second tees, and sixth tube sections horizontally connecting said tees of said second set to each other and to said elbow fitting there connected to said elbow fitting being cemented thereto, each second tee being spaced so as to be in line with a said first tee and receiving the upper end of said fifth vertical tube section, said generally rectangular assembly having also a set of intermediate third tees in between the successive second tees and connected to them by sixth tube sections, and (2) an upper, second generally rectangular assembly substantially identical to said first generally rectangular assembly and which, when said bottom portion is inverted so that said first rectangular assembly rests on a floor, is spaced well above said planar assembly, (3) a series of identical long vertical seventh tube sections substantially longer than said fifth tube sections joining the third tees of said first rectangular assembly to corresponding second tees of said second rectangular assembly, (4) a series of identical vertical eighth tube sections connecting said first tees to corresponding tees of said second, generally rectangular assembly, the combined lengths of each pair of fifth and eighth tube sections plus their fittings, equaling the length of the seventh tube sections.

2. A adjustable-sized, readily assembled and readily disassembled baby crib made up of a series of plastic tube sections and plastic tube fittings, said crib including in combination:

(1) an invertible bottom portion useful per se as small short crib and, when inverted, useful as a base portion of a taller playpen type of crib, comprising (a) a planar assembly of two pairs of cross fittings, each cross fitting having four horizontal, co-planar sockets at 90° intervals, two long lengthwise-extending tube sections of identical length connecting the cross fittings of each pair together, a shorter lengthwise-extending outboard tube section extending out from each cross-fitting in line with a said long tube section, all said shorter sections being identical in length, two long widthwise-extending tube sections, of identical length connecting corresponding cross fittings of one pair to those of the other pair and extending at 90° from said lengthwise sections, a shorter widthwise-extending outboard tube section, extending out from each cross fitting in line with a respective long widthwise-extending tube section, all said shorter widthwise sections being identical in length, so that there are four lengthwise outboard tube sections and four widthwise outboard tube sections, a first set of eight 90° tee fittings, each having three sockets, with one upper socket and one lower socket in line with each other, and one socket at the middle, 90° from said upper and lower sockets, said middle socket being attached to the distal end of each of the eight outboard tube sections, (b) a first series of eight vertical tube sections of identical length extending upwardly from the upper sockets of each said tee section, and (c) a first generally rectangular assembly, having an elbow fitting at each corner with two sockets at 90° to each other, a second set of at least eight tees, with two end sockets horizontally in line with each other, and tube sections horizontally connecting said tees of said second set to each other and to said elbow fittings, each tee having and a central vertical socket at 90° from the end sockets and facing downwardly and spaced so as to be in line with the tee of said first set of tee fittings below them and receiving the upper end of each said vertical tube section of said first series, said generally rectangular assembly having also a third set of intermediate tees in between the successive tees of said second set, and substantially identical thereto and connected to them by said tube sections of the assembly, and (2) an upper, second generally rectangular assembly substantially identical to said first generally rectangular assembly and which, when said bottom portion is inverted so that said first rectangular assembly rests on a floor, is spaced well above said planar assembly, (3) a second series of long vertical tube sections of identical length, substantially longer than the vertical tube sections of said first series, joining the central socket of said third set of intermediate tees to the corresponding tee of said second rectangular assembly, (4) a third series of vertical tube sections of identical length connecting the tees of said first section to tees of said second, generally rectangular assembly corresponding to the tees of the second set so that the combined lengths of the tube sections of said third series and those of said first series, plus their fittings equals those of said second series.

3. A portable, adjustable-sized, readily assembled and readily disassembled baby crib made up of a series of plastic tube sections and plastic tube fittings, said crib including in combination:

(a) a planar assembly of two pairs of cross fittings, each cross fitting having four horizontal, co-planar sockets at 90° intervals, two long lengthwise-extending tube sections of identical length connecting the cross fittings of each pair together, a shorter lengthwise-extending outboard tube section extending out from each cross-fitting in line with a said long tube section, all said shorter sections being identical in length, two long widthwise-extending tube sections, of identical length connecting corresponding cross fittings of one pair to those of the other pair and extending at 90° from said lengthwise sections, a shorter widthwise-extending outboard tube section, extending out from each cross fitting in line with a respective long widthwise-extending tube section, all said shorter widthwise sections being identical in length, so that there are four lengthwise outboard tube sections and four widthwise outboard tube sections, a first set of eight 90° tee fittings, each having three sockets, with one upper socket and one lower socket in line with each other, and one socket at the middle, 90° from said upper and lower sockets, said middle socket being attached to the distal end of each of the eight outboard tube sections, (b) a first series of eight vertical tube sections of identical length extending upwardly from the upper sockets of each said tee section, and (c) a first generally rectangular assembly, having an elbow fitting at each corner with two sockets at 90° to each other, a second set of at least eight tees, with two end sockets horizontally in line with each other, and tube sections horizontally connecting said tees of said second set to each other and to said elbow sections, and a central vertical socket at 90° from the end sockets and facing downwardly and spaced so as to be in line with the tee of said first set of tee fittings below them and receiving the upper end of each said vertical tube section of said first series, said generally rectangular assembly having also a third set of intermediate tees in between the successive tees of said second set, and substantially identical thereto and connected to them by said tube sections of the assembly.

* * * * *